US010759160B2

(12) United States Patent
Wei

(10) Patent No.: US 10,759,160 B2
(45) **Date of Patent: *Sep. 1, 2020**

(54) PRECISION POSITIONING DEVICE OF A UNIT-TYPE DIE CUTTING AND HOT STAMPING MACHINE AND A WORKING METHOD THEREOF

(71) Applicant: Tian-Sheng Liu, Taipei (TW)

(72) Inventor: Shu-Yuan Wei, Tianjin (CN)

(73) Assignee: Tian-Sheng Liu, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/576,304

(22) Filed: Sep. 19, 2019

(65) Prior Publication Data

US 2020/0009855 A1 Jan. 9, 2020

Related U.S. Application Data

(62) Division of application No. 15/643,310, filed on Jul. 6, 2017.

(30) Foreign Application Priority Data

Jul. 7, 2016 (CN) ..... 2016 1 0529416

(51) Int. Cl.
*B41F 1/30* (2006.01)
*B41F 16/00* (2006.01)
(Continued)

(52) U.S. Cl.
CPC ..... *B41F 1/30* (2013.01); *B26D 1/045* (2013.01); *B26D 5/24* (2013.01); *B26D 7/0006* (2013.01);
(Continued)

(58) Field of Classification Search
CPC ..... B41F 11/00; B41F 1/30
(Continued)

(56) References Cited

U.S. PATENT DOCUMENTS 3,847,079 A * 11/1974 Dahlgren ..... B41F 21/08 101/490
3,935,814 A 2/1976 Weisgerber
(Continued)

FOREIGN PATENT DOCUMENTS

CN 1613660 A 5/2005

*Primary Examiner* — Anthony H Nguyen
(74) *Attorney, Agent, or Firm* — Muncy, Geissler, Olds & Lowe, P.C.

(57) ABSTRACT

A precision positioning device of a unit-type die cutting & hot stamping machine includes a positioning element on an input end of a first imprinting element and a positioning element on an output end of each imprinting element. Two neighboring positioning elements accomplish the positioning between the two positioning elements together. Each positioning element is constituted by a positioning assembly installed symmetrically on each end of the imprinting element. The positioning assembly includes a positioning rod which can rotate against an installation shaft. Each positioning rod includes a positioning block which is provided with a reference surface. A rear side of the gripper is provided with a reference matching surface. By the positioning elements, the accuracy in the art of die cutting & hot stamping can be assured when the machine is performing a multiple-working-position procedure.

4 Claims, 10 Drawing Sheets

(51) Int. Cl.

| | |
|---|---|
| ***B41F 19/00*** | (2006.01) |
| ***B41F 21/08*** | (2006.01) |
| ***B26D 1/04*** | (2006.01) |
| ***B26D 5/24*** | (2006.01) |
| ***B26D 7/00*** | (2006.01) |
| ***B26D 7/01*** | (2006.01) |
| ***B26D 7/27*** | (2006.01) |
| ***B26F 1/44*** | (2006.01) |
| *B26D 7/08* | (2006.01) |

(52) U.S. Cl.
CPC ..... *B26D 7/015* (2013.01); *B26D 7/27* (2013.01); *B26F 1/44* (2013.01); *B41F 16/0026* (2013.01); *B41F 16/0046* (2013.01); *B41F 19/008* (2013.01); *B41F 21/08* (2013.01); *B26D 2007/082* (2013.01); *B26F 2001/4463* (2013.01)

(58) Field of Classification Search
USPC ..... 101/485
See application file for complete search history.

(56) References Cited

U.S. PATENT DOCUMENTS

| | | | | | |
|---|---|---|---|---|---|
| 4,058,307 | A * | 11/1977 | Bubley | B41F 15/22 | 271/85 |
| 4,443,094 | A | 4/1984 | Ricciardi | | |
| 4,596,184 | A | 6/1986 | Fischer | | |
| 4,846,061 | A * | 7/1989 | Jeschke | B41F 21/04 | 101/408 |
| 4,869,169 | A * | 9/1989 | Rebel | B41F 21/08 | 101/408 |
| 4,875,069 | A * | 10/1989 | Takada | B65H 5/12 | 399/304 |
| 5,125,334 | A | 6/1992 | Marx | | |
| 5,193,458 | A | 3/1993 | Keller | | |
| 5,562,279 | A * | 10/1996 | Gillieron | B41F 21/08 | 271/204 |
| 5,566,614 | A | 10/1996 | Ganter | | |
| 2004/0089178 | A1 * | 5/2004 | Muller | B41F 21/104 | 101/408 |
| 2008/0245250 | A1 * | 10/2008 | Kato | B41F 21/04 | 101/408 |
| 2016/0159078 | A1 | 6/2016 | Fujiwara | | |

* cited by examiner

PRECISION POSITIONING DEVICE OF A UNIT-TYPE DIE CUTTING AND HOT STAMPING MACHINE AND A WORKING METHOD THEREOF

CROSS REFERENCE TO RELATED APPLICATIONS

This application is a Divisional of co-pending application Ser. No. 15/643,310, filed on Jul. 6, 2017, for which priority is claimed under 35 U.S.C. § 120; and this application claims priority of Application No. 201610529416.1 filed in China on Jul. 7, 2016 under 35 U.S.C. § 119; and the entire contents of all of which are hereby incorporated by reference.

BACKGROUND OF THE INVENTION a) Field of the Invention

The present invention relates to the art of printing and a printing machine, and more particularly to a precision positioning device of a unit-type die cutting & hot stamping machine and a working method thereof.

b) Description of the Prior Art

For an existing multi-unit die cutting & hot stamping apparatus on the markets (Chinese patent No. ZL 200410093700.6), a multi-unit die pressing element and an aluminum foil control element are employed to accomplish multiple hot stamping (or indenting) and die cutting as required, which increases the production efficiency and shortens the production cycle considerably. However, paper delivered in this kind of apparatus is normally held and transmitted by multiple parallel installed grippers, wherein the grippers hold paper and enter into the workpieces in each unit along a track of closed loop to carry out die pressing. As the closed chain is long and is suffered from a frequent change in the magnitude and direction of tension during a long time of use, the deformation of chain will occur, which greatly reduces the printing accuracy of the apparatus due to the error accumulation of the chain.

For the inevitable printing error caused by the deformation error in the chain, no existing positioning device is able to do the fine tuning in time, and the positioning deviation will directly affect the processing accuracy. To guarantee the processing accuracy and quality of paper, the printing apparatus needs to be turned off for adjustment constantly, and this adjustment method will waste time and labor, which reduces the working efficiency of the apparatus and increases the labor cost.

In addition, if the printing apparatus is provided with plural workpieces in a unit, one will normally need to orderly carry out verification and fine tuning to each positioning device of the workpiece. Besides that, the paper positioning method is tedious and inaccurate.

SUMMARY OF THE INVENTION

The primary object of the present invention is to provide a precision positioning device of a unit-type die cutting & hot stamping machine and a working method thereof, which are capable of solving the shortcomings in the prior art. For the positioning device, the positioning is accomplished through matching a positioning block on a positioning rod at a rear side of gripper with a reference matching surface of the gripper. The positioning device is advantageous in consistency in the positioning reference, simplicity in the adjustment method, and optimization in structure features; whereas, the extension in the chain can be prevented effectively by determining the positioning reference and fine tuning the distance between the reference surface and the reference matching surface of the positioning device.

The technical means of the present invention discloses a precision positioning device of a unit-type die cutting & hot stamping machine. The said unit-type die cutting & hot stamping machine includes at least two imprinting elements, wherein paper of the imprinting elements is delivered by the gripper installed on the chain. The present invention is characterized in that the precision positioning device includes a positioning element disposed on an input end of a first imprinting element and a positioning element disposed on an output end of each imprinting element. Two neighboring positioning elements accomplish the positioning between the two positioning elements together. Each said positioning element is disposed parallel along the direction of deliver of the chain and the said positioning element is constituted by a positioning assembly installed symmetrically on each end of the imprinting element. The said positioning assembly includes a positioning rod which can rotate against an installation shaft. Each positioning rod is provided with a positioning block, and the said positioning block is provided with a reference surface. A rear side of the gripper is provided with a reference matching surface, and the positioning block is disposed on the rear side of the gripper to match with the reference matching surface. When an end of the positioning rod swings, the positioning block thereon is in contact with the reference matching surface on a connecting block, thereby carrying out the positioning work.

The said imprinting element includes a first unit imprinting element and a second unit imprinting element. The said precision positioning device includes a front positioning element disposed on an input end of the first unit imprinting element, a first unit rear positioning element disposed on an output end of the first unit imprinting element, and a second unit rear positioning element disposed on an output end of the second unit imprinting element. The front positioning element and the first unit rear positioning element accomplish the front positioning to the first unit imprinting element together, the first unit rear positioning element and the second unit rear positioning element accomplish the rear positioning to the second unit imprinting element together, and the three said positioning elements are parallel disposed along the direction of deliver of the chain.

The said positioning rod of the positioning assembly is provided with positioning blocks in different locations, and the gripper is provided with reference matching surfaces which match with the positioning blocks in the different locations.

Two ends of the said gripper are fixed on two transmission chains which are closed and parallel to each other. A gripper body of the gripper and the chain are fixed and connected through a connecting block; whereas, the said connecting block is provided with the reference matching surfaces.

The said connecting block is provided with a through-hole which is installed with an adjusting pin, and the adjusting pin can be adjusted toward right and left. The distance between the said reference matching surface and the reference surface of the positioning block is adjusted by the adjusting pin.

The distance between the said reference matching surface and the positioning block is adjusted by increasing an adjusting gasket with a thickness of 0.1 mm to 5 mm.

With the said imprinting element including a first unit imprinting element and a second unit imprinting element as an example, the said connecting block is provided with the reference matching surfaces I, II, III. The front positioning element, the first unit rear positioning element and the second unit rear positioning element are provided respectively with the positioning blocks I, II, III which match with the reference matching surfaces I, II, III respectively. When an end of the positioning rod of each positioning element swings, the positioning blocks I, II, III thereon are in contact with the reference matching surfaces I, II, III on the connecting block respectively, thereby carrying out the positioning work.

The said imprinting element includes a fixed platform and a movable platform. The fixed platform and the movable platform of each imprinting element can be installed with a die cutting or indenting tool to implement paper cutting and indenting.

The imprinting element in the said unit-type die cutting & hot stamping machine for accomplishing the hot stamping procedure includes an aluminum foil control element, constituting a hot foil stamping control element. The said hot foil stamping control element can be added to the aluminum foil control element transversally.

The fixed platform of the said imprinting element is installed with a heating system and a hot foil stamping tool to implement hot stamping.

The said chain is connected with tensioners.

A working method of the abovementioned precision positioning device of the unit-type die cutting & hot stamping machine is characterized in following steps:

(1) Selecting a positioning element as a positioning reference, meaning that the matching of the positioning block on the positioning rod with the corresponding reference matching surface of that positioning element is used as the positioning reference;

(2) Adjusting other positioning elements to accomplish positioning, meaning that the distance between the positioning block on the positioning rod and the corresponding reference matching surface in each positioning element is adjusted, assuring that the distance between two neighboring grippers is constant to accomplish positioning.

For fine tuning the distance between the said reference matching surface and the positioning block, the adjusting pin can be adjusted toward right or left to adjust the distance between the two; or, the distance between the two can be adjusted by increasing the adjusting gasket with a thickness of 0.1 mm to 5 mm, in order to compensate for the chain deformation caused by extension.

Each gripper sheet of the gripper body of the said gripper holds and moves paper to a working position for processing. The positioning rod swings, and the gripper body and the connection block ascend. When the positioning rod rotates to an end to contact with the reference matching surface of the connecting block, the initial positioning to the gripper is accomplished. The reference positioning is accomplished when the positioning block of the positioning element acting as the positioning reference is in contact with the corresponding reference matching surface; whereas, the positioning is accomplished by adjusting the distance between the positioning block and the corresponding reference matching surface of other positioning elements. Therefore, the precision positioning to all the imprinting elements is accomplished simultaneously. At this time, the paper imprinting procedure at each imprinting element starts. After accomplishing the paper processing, the positioning rod rotates counterclockwise, and the gripper body and the connecting block descend. At this time, the reference matching surface of the positioning block of the chain escapes from a positioning roller. When the positioning rod descends to the lowest point, the positioning rod will escape completely from the reference matching surface of the connecting block, and the gripper will hold and move paper to a next working position.

With the said imprinting element including the first unit imprinting element and the second unit imprinting element as an example, the gripper is provided with the reference matching surfaces I, II, III. The front positioning element disposed on the input end of the first unit imprinting element, the first unit rear positioning element disposed on the output end of the first unit imprinting element, and the second unit rear positioning element disposed on the output end of the second unit imprinting element are provided respectively with the positioning blocks I, II, III to match with the reference matching surfaces I, II, III respectively.

The positioning block II matches with the reference matching surface II of the first unit rear positioning element, acting as a positioning reference. The positioning block I matches with the reference matching surface I of the front positioning element, and the distance between the reference matching surface I and the positioning block I is adjusted, which implements the front positioning to the first unit imprinting element. The positioning block III matches with the reference matching surface III of the second unit rear positioning element, and the distance between the reference matching surface III and the positioning block III is adjusted, which implements the rear positioning to the second unit imprinting element.

The adjustment to the distance between the reference matching surface and the positioning block is performed by detecting the extension of the chain based upon the changes in the front positioning element and the first unit rear positioning element, and then adjusting the distance between the positioning block I and the reference matching surface I of the front positioning element, as well as by detecting the extension of the chain based upon the changes in the second unit rear positioning element and the first unit rear positioning element, and then adjusting the distance between the positioning block III and the reference matching surface III of the second unit rear positioning element.

The present invention is provided with the following advantages that:

(1) By providing the positioning elements on the multi-unit die cutting & hot stamping machine, the accuracy in the art of die cutting & hot stamping can be assured; whereas, at the same time, the working efficiency can be improved when the machine is performing a multiple-working-position procedure.

(2) By providing the reference positioning, the standards of the front and rear positioning are assured to be consistent, such that the unit-type die cutting & hot stamping machine can be provided with the advantages in a consistent positioning reference, a simple adjustment method and optimization in structures.

(3) The precision positioning is simple that the reference positioning, the front positioning and the rear positioning can be implemented only by changing the location of the positioning block on the positioning rod.

(4) The positioning rod is designed separately from the positioning block having a high accurate reference surface. This kind of assembly-type design solution facilitates serial production and optimization in the production procedure. In addition, the reference surface after wearing in the positioning procedure can be replaced easily, and the positioning block can facilitate processing into the reference surface that requires a higher accuracy.

(5) The reference matching surface is disposed on the rear side of the gripper, which facilitates implementing the precision positioning to prevent the chain from extension effectively.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
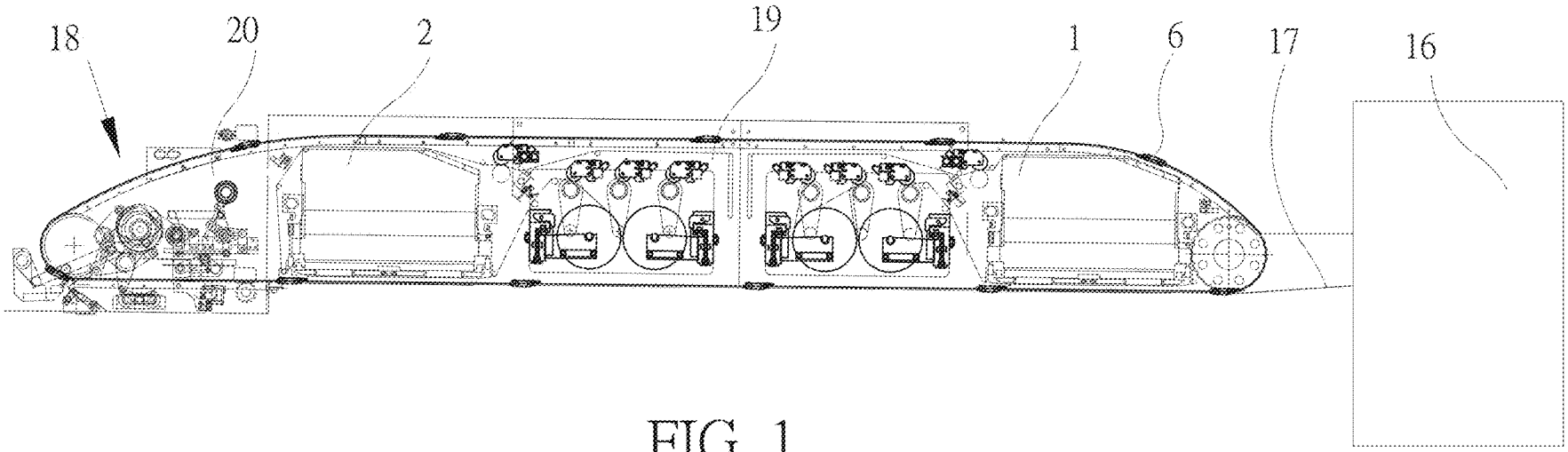
FIG. 1 shows a schematic view of a precision positioning device of a unit-type die cutting & hot stamping machine, according to the present invention.

In the present embodiment, a double-unit imprinting element is used as an example for description and is only used to allow a person in this technical field to understand the present invention more comprehensively, without limiting the present invention in any way of restriction.

Referring to FIG. 1 to FIG. 7, a precision positioning device used for a unit-type die cutting & hot stamping machine comprises a paper delivering element 16, an imprinting element and a paper receiving element 20. These parts are carried and surrounded commonly by a casing 18.

Paper 17 for imprinting is delivered by a gripper 6 installed on chains 8. Two ends of the said gripper 6 are fixed on two transmission chains 8 which are closed and parallel to each other, a grip body 11 of the gripper 6 and the chain 8 are fixed and connected through a connecting block 10 (as shown in FIG. 1 and FIG. 2).

The said imprinting element includes a fixed platform and a movable platform. The fixed platform and the movable platform of each imprinting element can be installed with a die cutting or indenting tool to implement paper cutting and indenting (as shown in FIG. 1 and FIG. 2).

The imprinting element in the said unit-type die cutting & hot stamping machine for accomplishing the hot stamping procedure includes an aluminum foil control element, constituting a hot foil stamping control element. The said hot foil stamping control element can be added to the aluminum foil control element transversally (as shown in FIG. 1 and FIG. 2).

Figure 2:
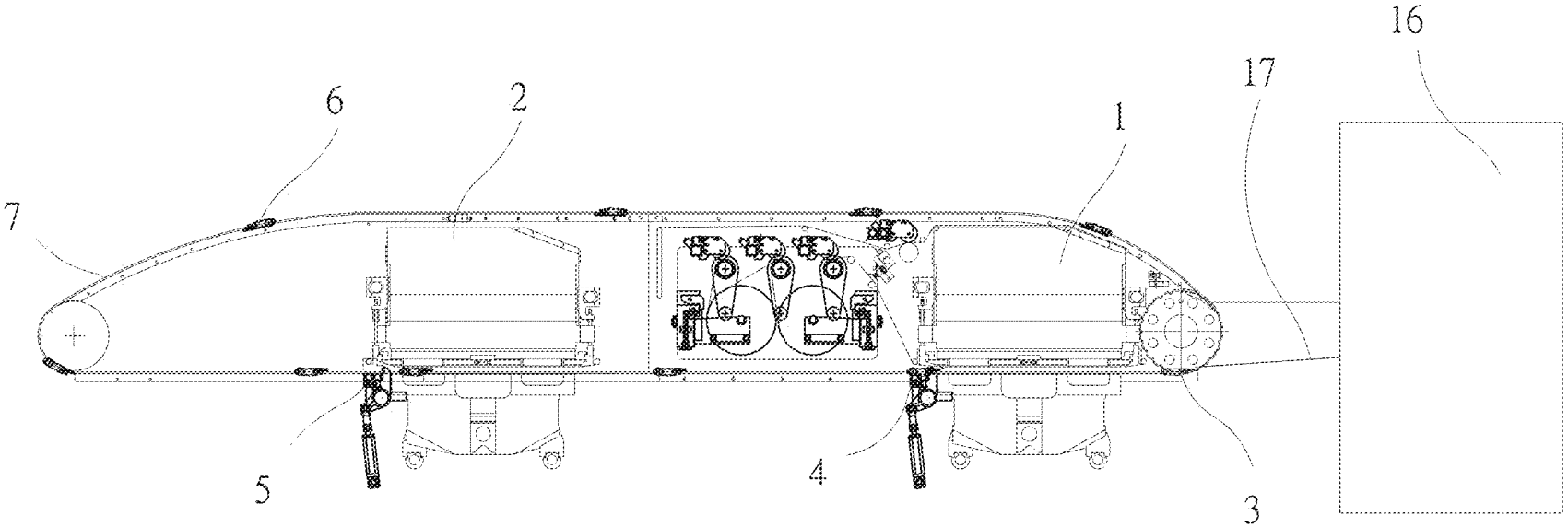
FIG. 2 shows another schematic view of the precision positioning device of a unit-type die cutting & hot stamping machine, according to the present invention.

The fixed platform of the said imprinting element is installed with a heating system and a hot foil stamping tool to implement the hot stamping function (as shown in FIG. 1 and FIG. 2).

Figure 3:
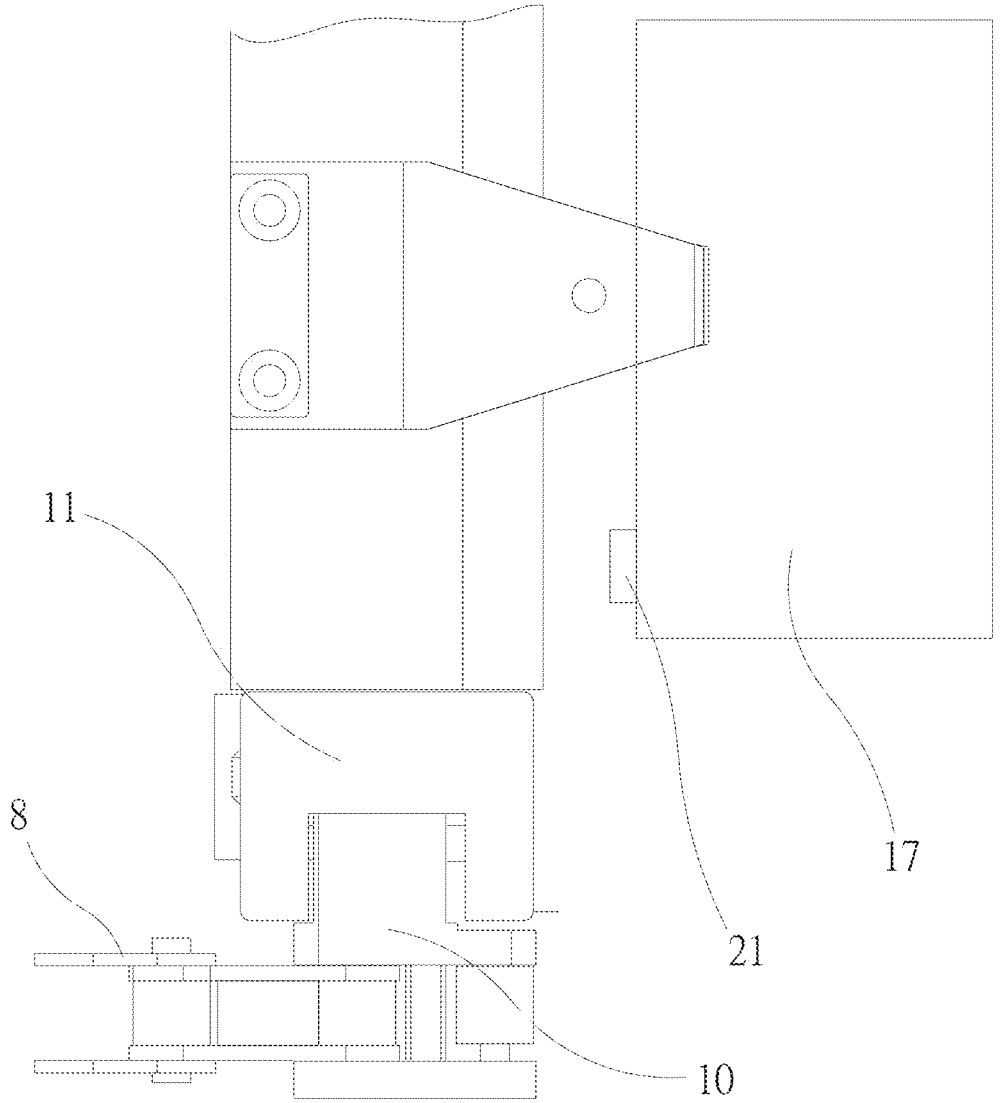
FIG. 3 shows a front view of a positioning element, according to the present invention.

The said chain 8 (as shown in FIG. 3) is connected with tensioners 7 (as shown in FIG. 2).

With the imprinting element of the unit-type die cutting & hot stamping machine including a first unit imprinting element and a second unit imprinting element as an example, the said imprinting element is provided with a precision positioning device. The said precision positioning element includes a front positioning element 3 disposed on an input end of the first unit imprinting element 1, a first unit rear positioning element 4 disposed on an output end of the first unit imprinting element 1, and a second unit rear positioning element 5 disposed on an output end of the second unit imprinting element 2. The front positioning element 3 and the first unit rear positioning element 4 accomplish the front positioning to the first unit imprinting element 1 together, the first unit rear positioning element 4 and the second unit rear positioning element 5 accomplish the rear positioning to the second unit imprinting element 2 together, and the three said positioning elements are disposed parallel along the direction of deliver of the chain (as shown in FIG. 2).

In the fine tuning process of the imprinting elements, one of the three positioning elements (the front positioning element 3, the first unit rear positioning element 4, and the second unit rear positioning element 5) is used as a reference, and the distance between the other two positioning elements and the reference positioning element is adjusted.

Figure 4:
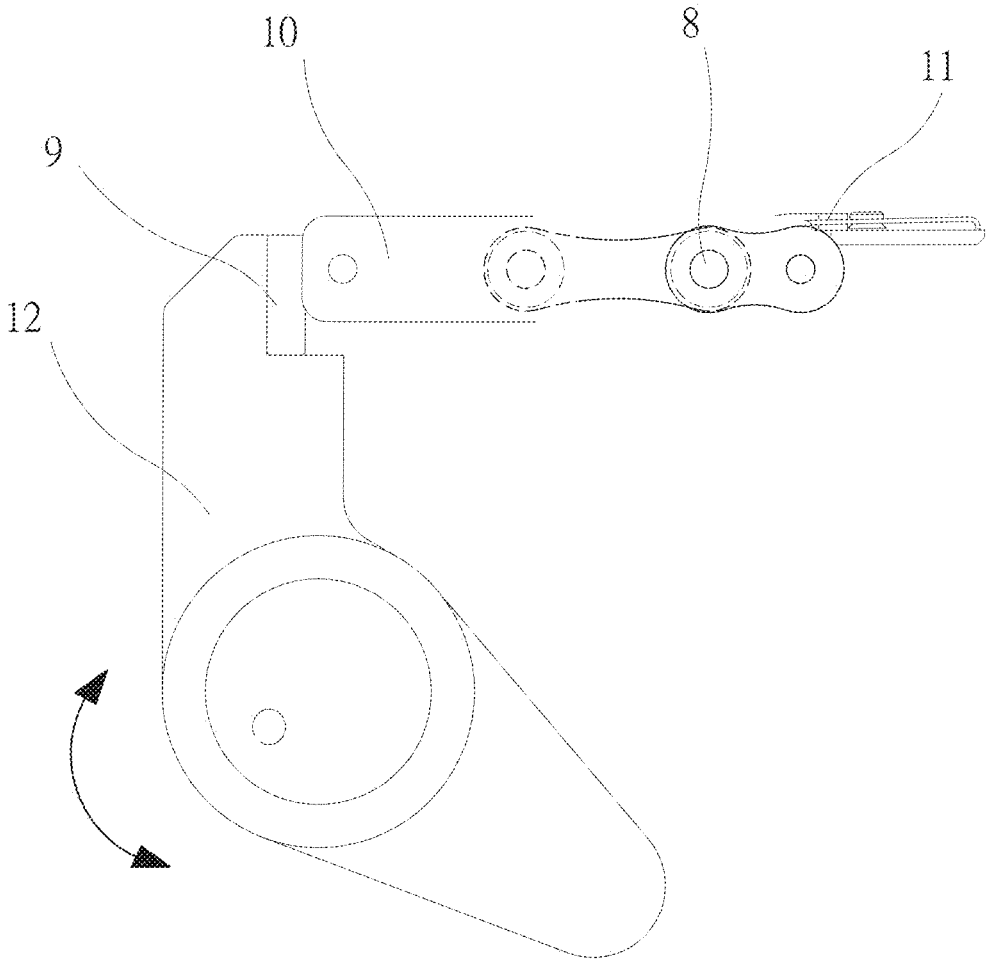
FIGS. 4 to 6 show top views of the positioning element that the distance is adjusted by increasing an adjusting gasket, according to the present invention.
Figure 5:
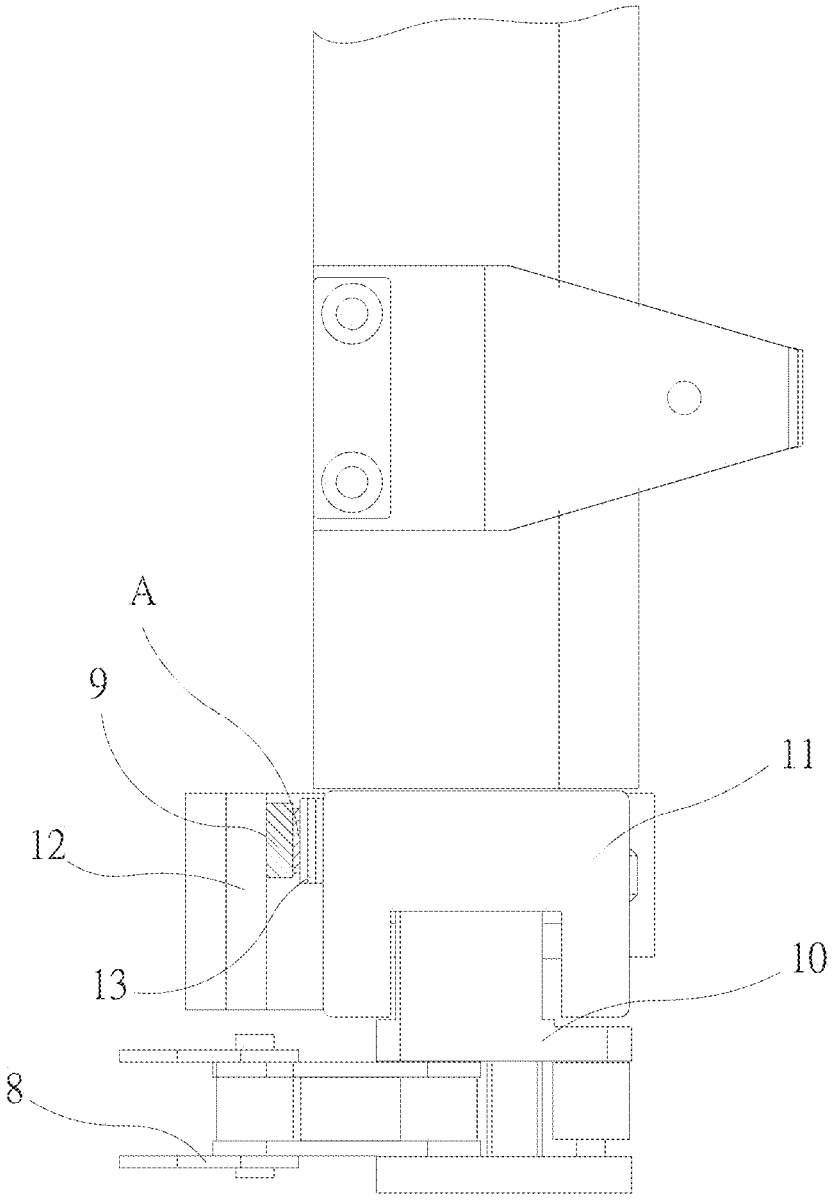
Figure 6:
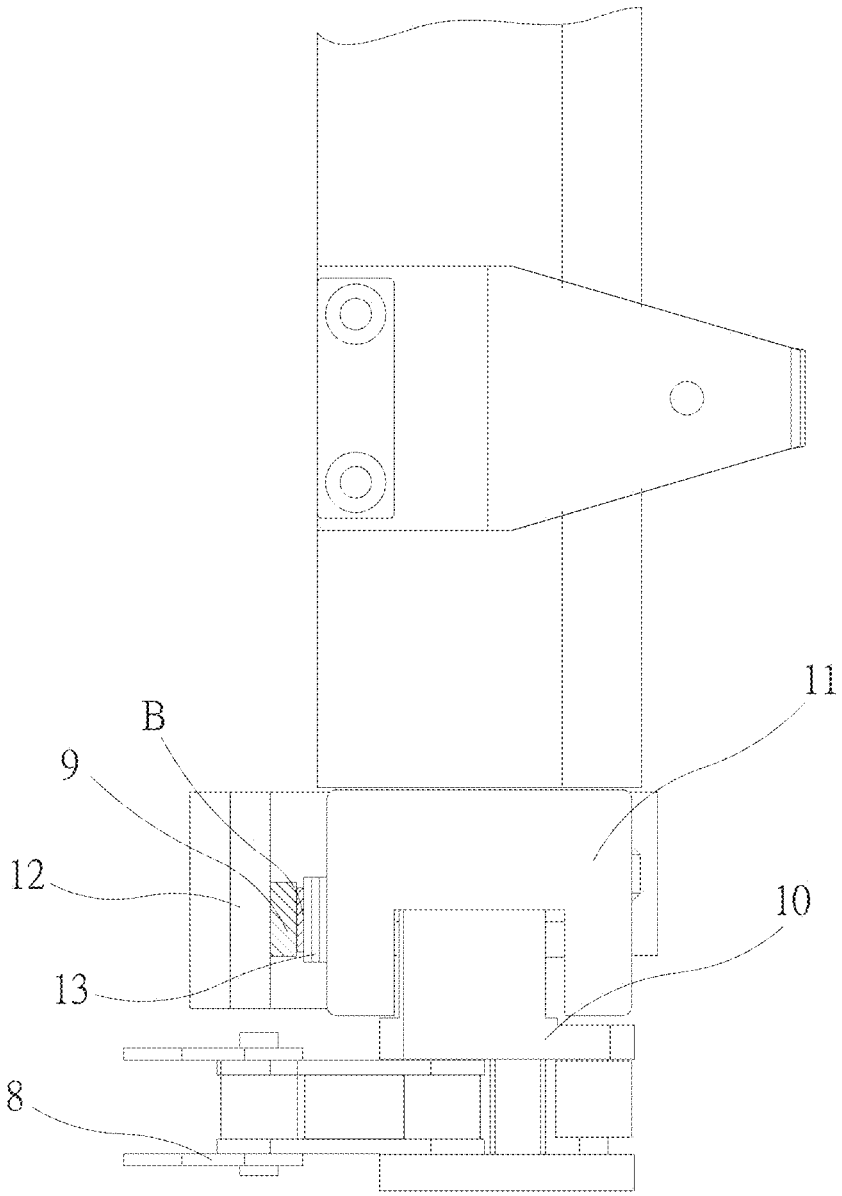

Using the first unit rear positioning element 4 as an example, the structure configurations for the three positioning elements are shown in FIGS. 4 to 6.

Referring to FIG. 1 to FIG. 10, the front positioning element 3 is constituted by a positioning assembly installed symmetrically at each end of the imprinting element. The said positioning assembly includes a positioning rod 12 which can rotate against an installation shaft, as well as a gripper body 11 of the gripper 6. A rear side of the said gripper body 11 is provided with a reference matching surface I A, and the said positioning rod 12 is provided with a positioning block 9 which matches with the reference matching surface IA.

The first unit rear positioning element 4 is constituted by a positioning assembly installed at each end of the imprinting element. The said positioning assembly includes a positioning rod 12 which can rotate against an installation shaft, as well as a gripper body 11 of the gripper 6. A rear side of the said gripper body 11 is provided with a reference matching surface IIB, and the said positioning rod 12 is provided with a positioning block 9 which matches with the reference matching surface IIB.

Referring to FIG. 2 to FIG. 6, the second unit rear positioning element 5 is constituted by a positioning assembly installed at each end of the imprinting element. The said positioning assembly includes a positioning rod 12 which can rotate against an installation shaft, as well as a gripper body 11 of the gripper 6. A rear side of the said gripper body 11 is provided with a reference matching surface IIIC, and the said positioning rod 12 is provided with a positioning block 9 which matches with the reference matching surface IIIC.

The surface on which the positioning block 9 matches with the reference matching surface is the reference surface. The positioning rod 12 is disposed on the rear side of the gripper 6.

Upon carrying out a precision positioning work, the reference surface of the reference positioning element (i.e., the first unit rear positioning element 4) is tightly in contact with the reference matching surface. The front positioning work is accomplished by increasing or decreasing an adjusting gasket 13 between the reference surface of the positioning block 9 and the reference matching surface IA of the front positioning element 3; whereas, the rear positioning work is accomplished by increasing or decreasing the adjusting gasket 13 between the reference surface of the positioning block 9 and the reference matching surface IIIC of the second unit rear positioning element 5.

In addition, to facilitate the need for serial production, the gripper bodies 11 of the three positioning elements can all be provided with the reference matching surfaces IA, IIB, IIIC. The positioning block 9 of each positioning assembly is disposed at a location matching with the reference matching surface IA, IIB, IIIC respectively. The reference matching surfaces IA, IIB, IIIC of the gripper bodies and the corresponding positioning blocks 9 accomplish the fine tuning action together, and the distance between the reference matching surface and the positioning block 9 is adjusted by increasing or decreasing the adjusting gasket 13 to accomplish positioning.

Figure 7:
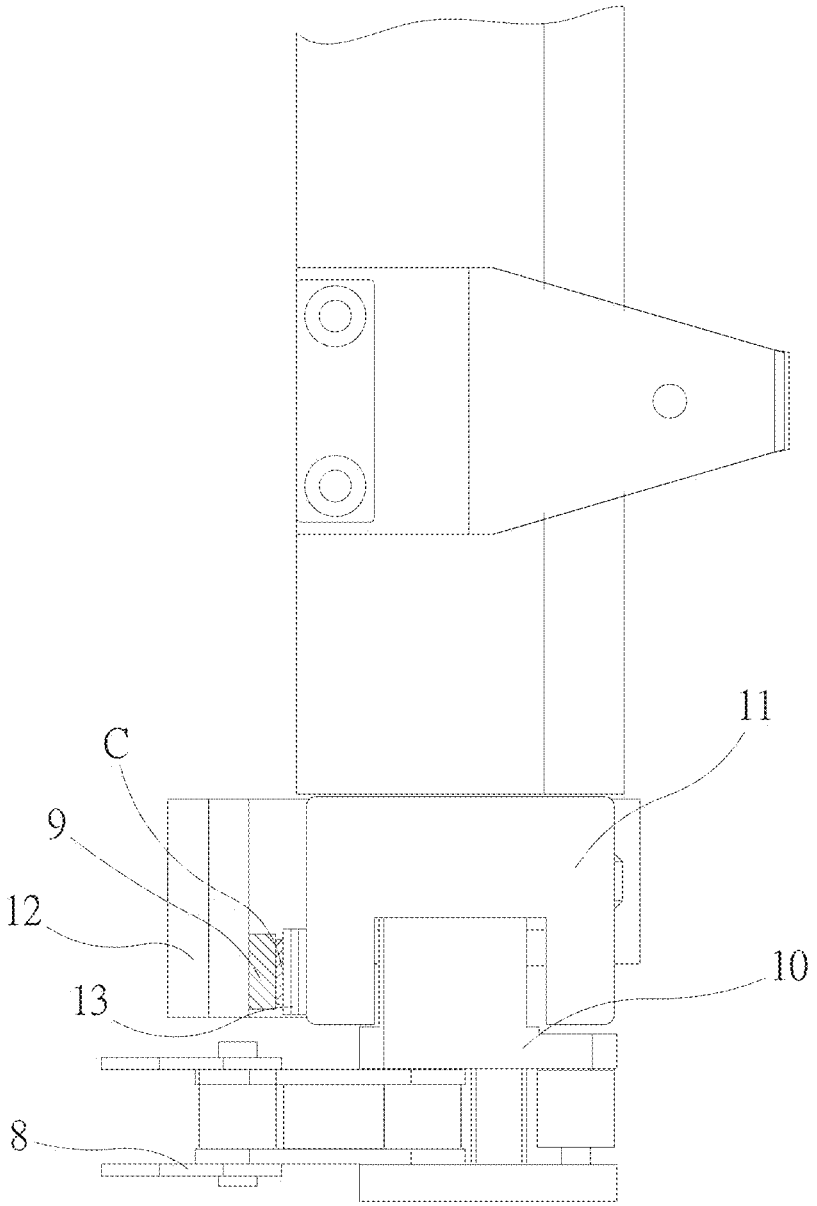
FIG. 7 shows a top view of the positioning element that the distance is adjusted by an adjusting pin, according to the present invention.
Figure 8:
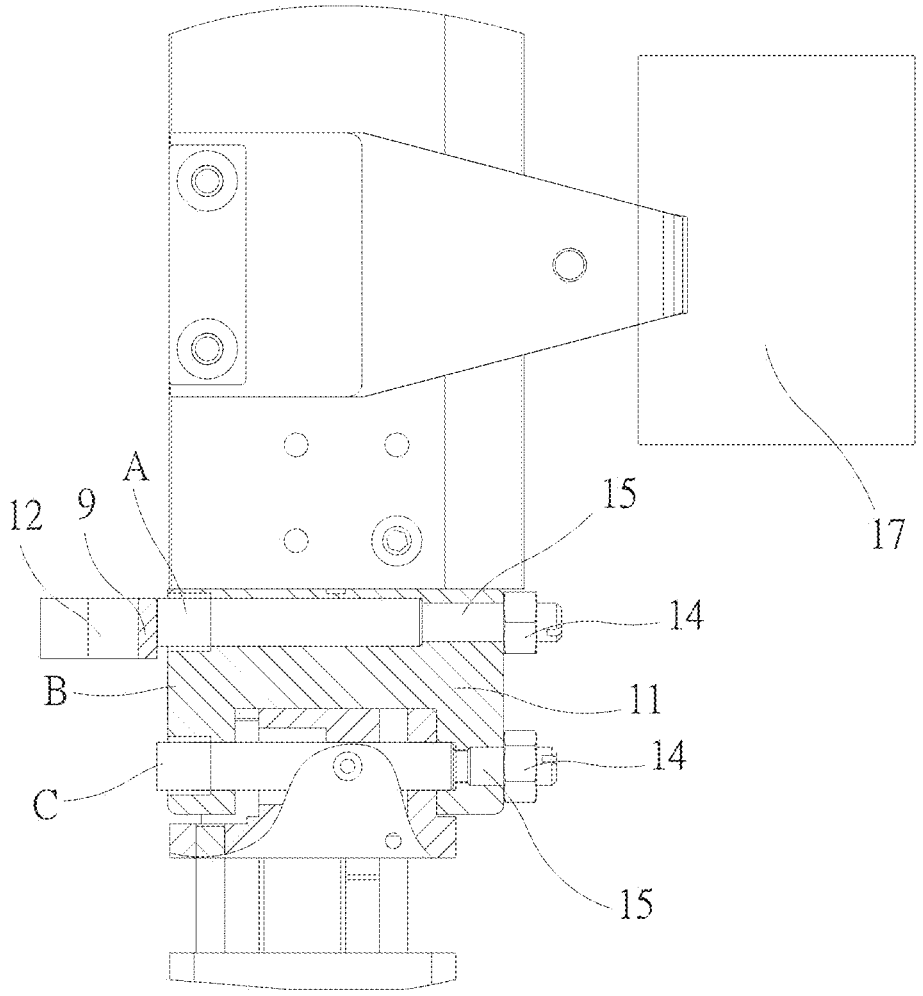
FIGS. 8-10 show views of the positioning element, according to the present invention.
Figure 9:
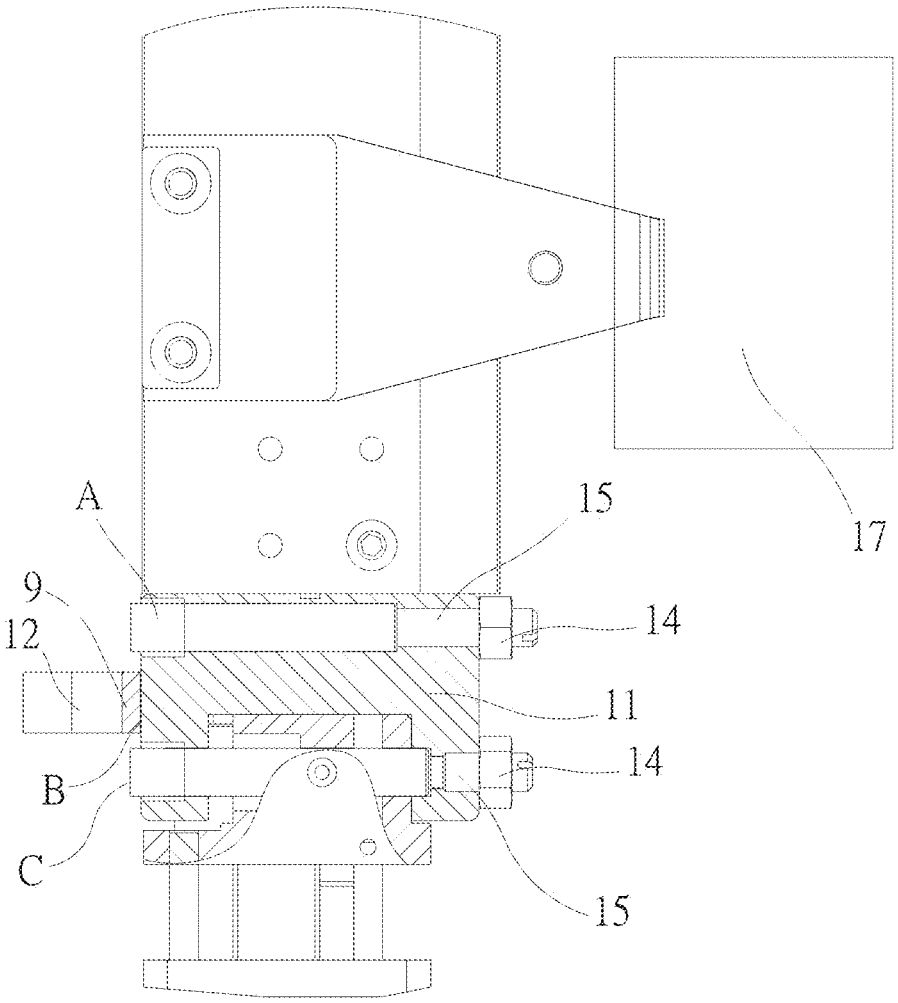
Figure 10:
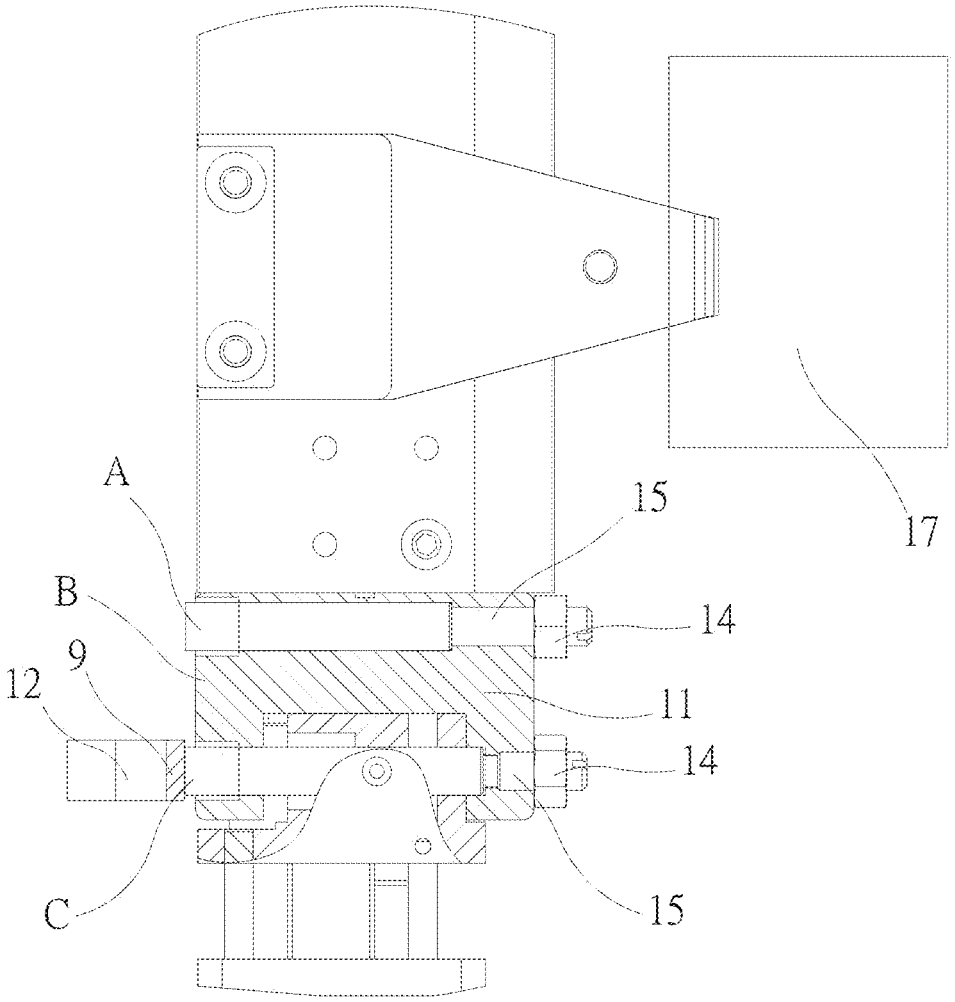

A second embodiment is shown in FIGS. 7 to 9. The gripper body 11 is provided with through-holes and each of the said through-holes is installed with an adjusting pin 15. The said adjusting pin 15 is locked tightly by a tightening nut 14, and it is preferred to adjust the adjusting pin 15 toward right or left. By adjusting the tightening nut 14 to adjust the distance between the reference matching surface of the adjusting pin 15 and the reference surface of the positioning block 9, the positioning work is accomplished.

As shown in FIGS. 2 and 8, using the first unit rear positioning element 4 as the reference positioning, the reference surface of the positioning block 9 is in contact with the reference matching surface IIB of the gripper body 11, forming a reference positioning surface.

Upon carrying out a fine tuning work, the front positioning element 3 and the second unit rear positioning element 5 (as shown in FIG. 2) are adjusted respectively, in accordance with the reference positioning surface. Referring to FIGS. 7 and 8, by adjusting the tightening nut 14, the reference matching surface IA of the adjusting pin 15 is made to move toward paper, thereby accomplishing the front positioning work. As shown in FIG. 9, by adjusting the tightening nut 14, the reference matching surface IIIC of the adjusting pin 15 is made to move away from paper, thereby accomplishing the rear positioning work. By assuring the distance between two positioning elements to be constant, paper of each positioning element can be guaranteed to reach the established working position.

The present invention also discloses a working method of the precision positioning device used for the unit-type die cutting & hot stamping machine. The working method is characterized in following steps:

(1) Selecting a positioning element as a positioning reference, meaning that the tightly contact of the reference surface of the positioning block 9 on the positioning rod with the reference matching surface of the gripper 6 of that positioning element is used as the positioning reference;

(2) Adjusting other positioning elements to accomplish positioning, meaning that the distance between the positioning block 9 on the positioning rod 12 and the corresponding reference matching surface on the gripper 6 in each positioning element is adjusted, assuring that the distance between two neighboring grippers 6 is constant to accomplish positioning.

For fine tuning the distance between the said reference matching surface and the positioning block 9, the distance between the two can be adjusted by increasing the adjusting gasket with a thickness of 0.1 mm to 5 mm to compensate for the deformation in chain 8 caused by extension, or the adjusting pin can be adjusted toward right or left to adjust the distance between the two.

Each gripper sheet of the gripper body 11 of the said gripper 6 holds and moves paper to a working position for processing. The positioning rod 12 rotates, and the gripper body 11 and the connecting block 10 ascend. When the positioning rod 12 rotates to an end to contact with the reference matching surface of the connecting block 10, the initial positioning to the gripper 6 is accomplished. The reference positioning is accomplished when the positioning block 9 of the positioning element acting as the positioning reference is in contact with the corresponding reference matching surface; whereas, the positioning is accomplished by adjusting the distance between the positioning block 9 of other positioning elements and the corresponding reference matching surface. Therefore, the precision positioning to all the imprinting elements is accomplished simultaneously. At this time, the paper imprinting procedure at each imprinting element starts. After accomplishing the paper processing, the positioning rod 12 rotates counterclockwise, and the gripper body 11 and the connecting block 10 descend. At this time, the reference matching surface of the positioning block of the chain escapes from a positioning roller. When the positioning rod 12 descends to the lowest point, the positioning rod 12 will escape completely from the reference matching surface of the connecting block 10, and the gripper 6 will hold and move paper to a next working position.

Each gripper sheet of the gripper body 11 of the said gripper 6 holds and moves paper to a working position for processing. The positioning rod 12 rotates counterclockwise, and the gripper body 11 and the connecting block 10 ascend. When the positioning rod 12 rotates to an end to contact with the reference matching surface of the connecting block 10, the initial positioning to the gripper 6 is accomplished. The reference positioning is accomplished when the reference matching surface IIB of the connecting block 10 is in contact with the reference surface of the positioning block 9 of the first unit rear positioning element 4; whereas, the front positioning to the first unit imprinting element 1 is accomplished by adjusting the distance between the positioning block 9 and the reference matching surface IA of the front positioning element 3 to compensate for the deformation error of the chain 8 caused by extension and assure the distance between the front gripper 6 and the rear gripper 6 of the first unit imprinting element 1 to be constant. At the same time, the rear positioning to the second unit imprinting element 2 is accomplished by adjusting the distance between the positioning block 9 and the reference matching surface IIIC of the second unit rear positioning element 5 to assure that the distance between the front gripper 6 and the rear gripper 6 of the second unit imprinting element 2 is constant. Therefore, the precision positioning to two imprinting elements is accomplished simultaneously, and at this time, two paper imprinting procedures start. After accomplishing the paper processing, the positioning rod 12 rotates clockwise, and the gripper body 11 and the connecting block 10 descend. At this time, the reference matching surface of the positioning block of the chain 8 escapes from a positioning roller. When the positioning rod 12 descends to the lowest point, the positioning rod 12 will escape completely from the reference matching surface of the connecting block 10, and the gripper 6 will hold and move paper to a next working position.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A working method of a precision positioning device of a unit-type die cutting and hot stamping machine having two imprinting elements, and paper of the imprinting elements being delivered by a gripper of positioning elements installed on a chain, comprising following steps:

a) selecting a first positioning element as a positioning reference, the positioning reference being determined by matching between a positioning block on a positioning rod and a corresponding reference matching surface on the gripper of the first positioning element;

b) adjusting a distance between the positioning block on the positioning rod and the corresponding reference matching surface on the gripper in each of second positioning elements to assure that a distance between two of the grippers of the first positioning element and the second positioning elements is constant, thereby accomplishing a positioning work.

2. The working method of the precision positioning device of a unit-type die cutting and hot stamping machine, according to claim 1, wherein for fine tuning the distance between the reference matching surface and the positioning block, the distance between the reference matching surface and the positioning block is adjusted by rotating an adjusting pin towards right or left to compensate for the chain deformation caused by extension.

3. The working method of the precision positioning device of a unit-type die cutting and hot stamping machine, according to claim 1, wherein each gripper sheet of a gripper body of the gripper holds and moves the paper to a working position for processing, the positioning rod swings, and the gripper body and a connecting block ascend;

when the positioning rod swings to an end to contact with the reference matching surface of the connecting block, initial positioning to the gripper being accomplished; the reference positioning being accomplished when the positioning block of the positioning element acting as the positioning reference is in contact with the corresponding reference matching surface; the positioning being accomplished by adjusting the distance between the positioning block and the corresponding reference matching surface of the second positioning elements; the precision positioning to all the imprinting elements being accomplished simultaneously, and at this time, a paper imprinting procedure at each imprinting element starting; after accomplishing the paper imprinting procedure, the positioning rod rotating counterclockwise, and the gripper body and the connecting block descending, whereas at this time, the reference matching surface of the positioning block of the chain escaping from the positioning rod; when the positioning rod descending to the lowest point, the positioning rod escaping completely from the reference matching surface of the connecting block, and the gripper holding and moving paper to a next working position.

4. The working method of the precision positioning device of a unit-type die cutting and hot stamping machine, according to claim 1, wherein for fine tuning the distance between the reference matching surface and the positioning block, the distance between the reference matching surface and the positioning block is adjusted by increasing or decreasing an adjusting gasket with a thickness of 0.1 mm to 5 mm between the reference matching surface and the positioning block to compensate for the chain deformation caused by extension.

* * * * *